US005300161A

United States Patent [19]

Gifford

[11] Patent Number: 5,300,161

[45] Date of Patent: Apr. 5, 1994

[54] METHOD FOR REGISTERING BOTTLES

[75] Inventor: Eric Gifford, Chargin Falls, Ohio

[73] Assignee: Automated Label Systems Company, Twinsburg, Ohio

[21] Appl. No.: 99,871

[22] Filed: Jul. 30, 1993

Related U.S. Application Data

[62] Division of Ser. No. 708,509, May 31, 1991, Pat. No. 5,232,541.

[51] Int. Cl.[5] ..... B65C 9/00

[52] U.S. Cl. ..... 156/64; 156/86; 156/366; 156/558; 156/566; 198/345.1

[58] Field of Search ..... 156/64, 84–86, 156/229, 556, 366, 558, 559, 566; 198/345.1, 468.11

[56] References Cited

U.S. PATENT DOCUMENTS

| | | | |
|---|---|---|---|
| 1,594,465 | 8/1926 | Miller | 198/460.11 |
| 2,319,908 | 5/1943 | Walter | 198/460.11 |
| 2,579,631 | 12/1951 | Von Hote et al. | 156/566 |
| 2,681,758 | 6/1954 | Lipson | 198/345.1 |
| 2,751,735 | 6/1956 | Bartlett et al. . | |
| 2,846,835 | 8/1958 | Aguilar et al. . | |
| 3,355,856 | 12/1967 | Randrup . | |
| 3,924,387 | 12/1975 | Konstantin . | |
| 4,102,728 | 7/1978 | .Smith . | |
| 4,243,466 | 1/1981 | Lindee . | |
| 4,412,876 | 11/1983 | Lerner et al. | 156/566 |
| 4,638,756 | 1/1987 | Collmann . | |
| 4,881,882 | 11/1989 | Fantacci . | |
| 4,944,825 | 7/1990 | Gifford et al. | 156/556 |

*Primary Examiner*—David A. Simmons
*Assistant Examiner*—William J. Matney, Jr.
*Attorney, Agent, or Firm*—Watts, Hoffmann, Fisher & Heinke Co.

[57] ABSTRACT

A methods is disclosed for labeling bottles in a stream. An input conveyor is provided for supplying bottles to a presenting station. Bottles are restrained at the presenting station until the appropriate time by an entrance gate. Bottles are conveyed from the presenting station to a work station by an advancing conveyor. Bottles entering the work station drive the predecessor bottle out of the work station. An exit gate is provided to halt bottles leaving the work station so that they act as a registration stop for bottles entering the work station.

10 Claims, 6 Drawing Sheets

METHOD FOR REGISTERING BOTTLES

This is a division of copending application Ser. No. 07/708,509, filed on May 31, 1991, now U.S. Pat. No. 5,232,541, issued Aug. 3, 1993.

BACKGROUND OF THE INVENTION

1. Field of the Invention

The invention relates generally to apparatuses and methods for labeling products, and more particularly, to apparatuses and methods for applying flexible, tubular labels to containers.

2. Background Information

Tubular, flexible, labels have become popular for labeling plastic "two-liter" bottles. Apparatus and methods for automatically placing tubular labels on empty containers have been developed. Recently it has been found desirable to label bottles filled with fluid. Labeling filled bottles presents special problems for labeling machines due to the added mass of the fluid and the effect of the fluid mass moving within the bottle. One apparatus and method for labeling filled bottles disclosed in U.S. Pat. No. 4,944,825 has been developed by the present assignee with considerable success. However, this apparatus requires costly specialized parts, does not adapt well to variations in bottle shapes and will occasionally jam and damage bottles. Fluid-filled bottles create greater problems when damaged in a labeling operation because the contents spill over the machinery and other bottles. Therefore, a need has arisen for a high speed filled bottle labeler which can be manufactured at low cost, which accepts variations in the shapes of bottles to be labeled, and which reduces jams and down time.

SUMMARY OF THE INVENTION

A new labeling apparatus is provided which is insensitive to bottle shape variations, is highly reliable and uses commonly available parts. The labeling apparatus of the present invention includes a label applying assembly and a product advancing assembly. The product advancing assembly includes an advancing conveyor for advancing an unlabeled product from a product presenting position to a label applying position. A movable gate is located a predetermined distance downstream from the label applying position for intermittently blocking the path of a labeled product downstream of the unlabeled product. The unlabeled product is registered with respect to the label applying position by abutting against the blocked labeled product. The movable gate operates to release the labeled product once the unlabeled product is registered. A timing device is provided for synchronizing the movement of the label applying assembly with that of the advancing conveyor and the gate.

In the preferred and illustrated embodiment, the labeling apparatus further includes an entrance gate for preventing products in the presenting station from approaching the labeling position until the appropriate time.

A new method is also provided for applying labels to products. The method includes advancing a product to be labeled to a product presenting position using a conveyor. A product is engaged at the presenting position with an advancing conveyor and driven toward a labeling station. The driven product pushes a predecessor product out of the labeling station. The predecessor product is halted by a downstream gate. The driven product is then registered against the halted product. The halted product is released to be conveyed further downstream. Thereafter, a label is applied to the registered product.

In the preferred method, an entrance gate is operated to block the path between the presenting station and the label applying position until the advancing conveyor begins to drive a product toward the labeling position.

DESCRIPTION OF THE PREFERRED EMBODIMENT

Figure 1:
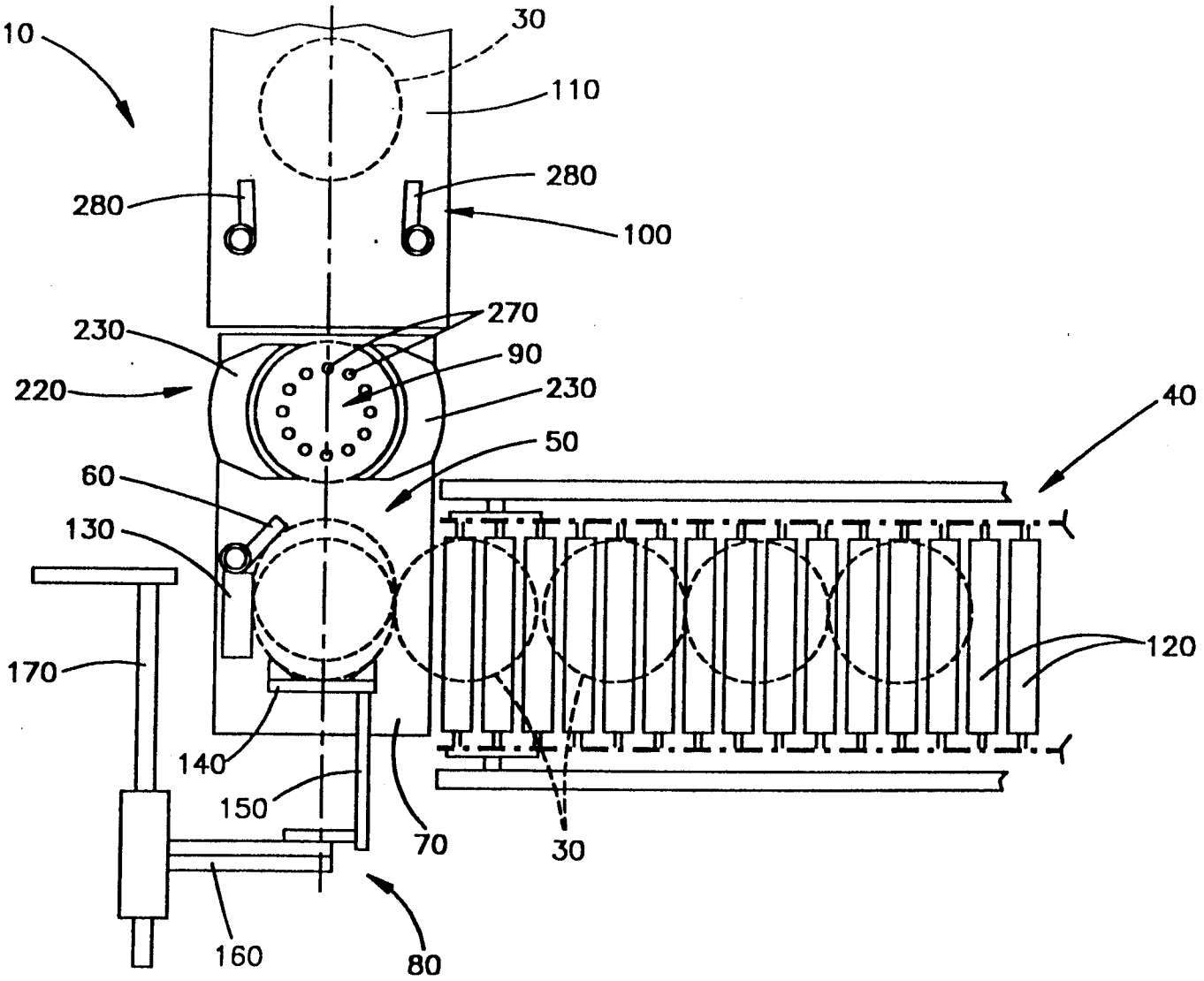
FIG. 1 is a schematic plan view showing a labeling apparatus in accordance with the present invention.

Referring to FIGS. 1–5, a labeling apparatus 10 is shown for applying sleeve labels 20 to individual bottles 30. With reference to FIG. 1, the apparatus includes an input conveyor 40, a presenting station 50, an entrance gate 60, a slide plate 70, an advancing conveyor 80, a work station 90, an exit gate 100, and an exit conveyor 110. The labeling apparatus 10 isolates and registers individual bottles 30 in a stream of bottles. The bottles 30 are isolated and registered at the work station 90 where a labeling applying tool 230 applies a label 20 to each bottle 30.

The stream of bottles is brought to the presenting station 50 by the input conveyor 40. The preferred input conveyor 40 is a continuously running roller chain conveyor of the type disclosed in FIGS. 10 and 11 of U.S. Pat. No. 4,944,825, which is hereby incorporated by reference. Bottles 30 on the input conveyor 40 are continuously urged in the downstream direction toward the presenting station 50. If a bottle occupies the presenting station 50, as illustrated in FIG. 1, each bottle 30 on the input conveyor 40 is obstructed from moving forward by its neighboring downstream bottle The bottles 30 on the input conveyor 40 may remain stationary while the input conveyor 40 continues to move beneath them by virtue of free-wheeling rollers 120. With this arrangement, bottles are continuously urged toward the presenting station 50 and a bottle 30 will only be pushed into the presenting station 50 when it is unoccupied.

Figure 2:
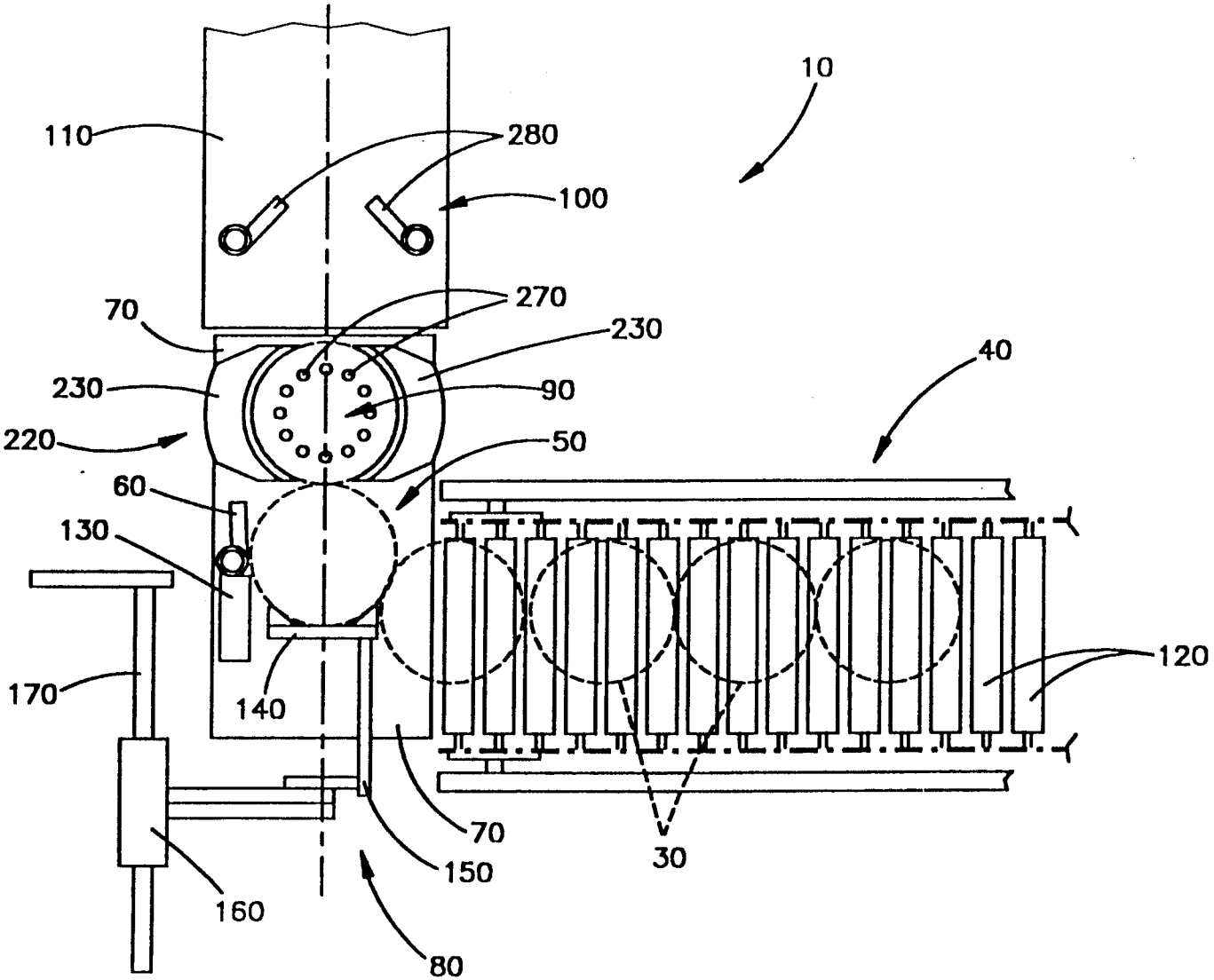
FIG. 2 is the view of FIG. 1 at a later time in the labeling cycle.
Figure 3:
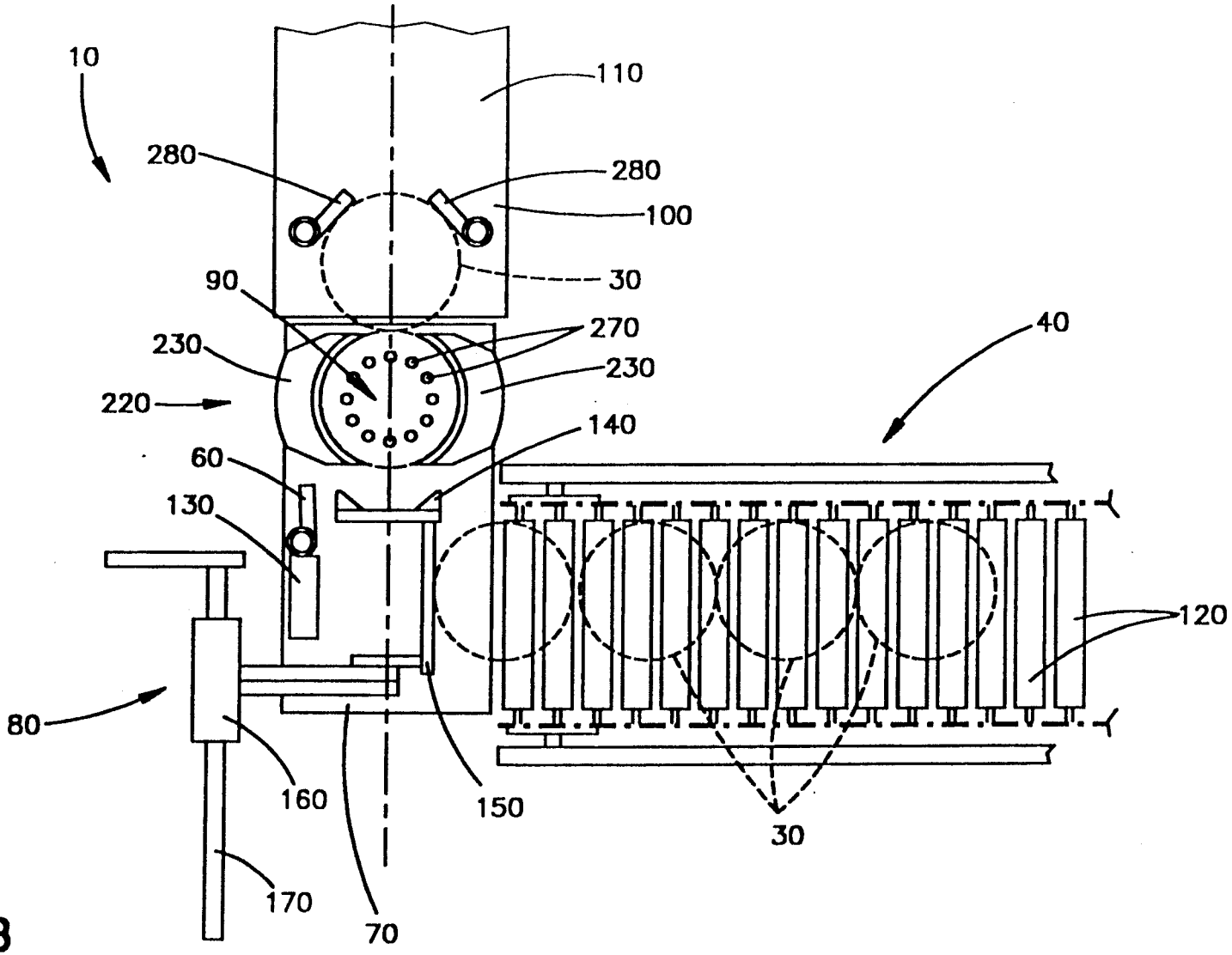
FIG. 3 is the view of FIG. 1 at a still later time in the labeling cycle.

Underlying the presenting station 50 is the slide plate 70, which is simply a smooth flat plate. Bottles 30 leaving the input conveyor 40 are pushed onto the slide plate 70 where each eventually contacts a stop 130. The slide plate 70 extends in the downstream direction from the presenting station 50 to the exit conveyor 110 as illustrated in FIGS. 1–3.

Figure 4:
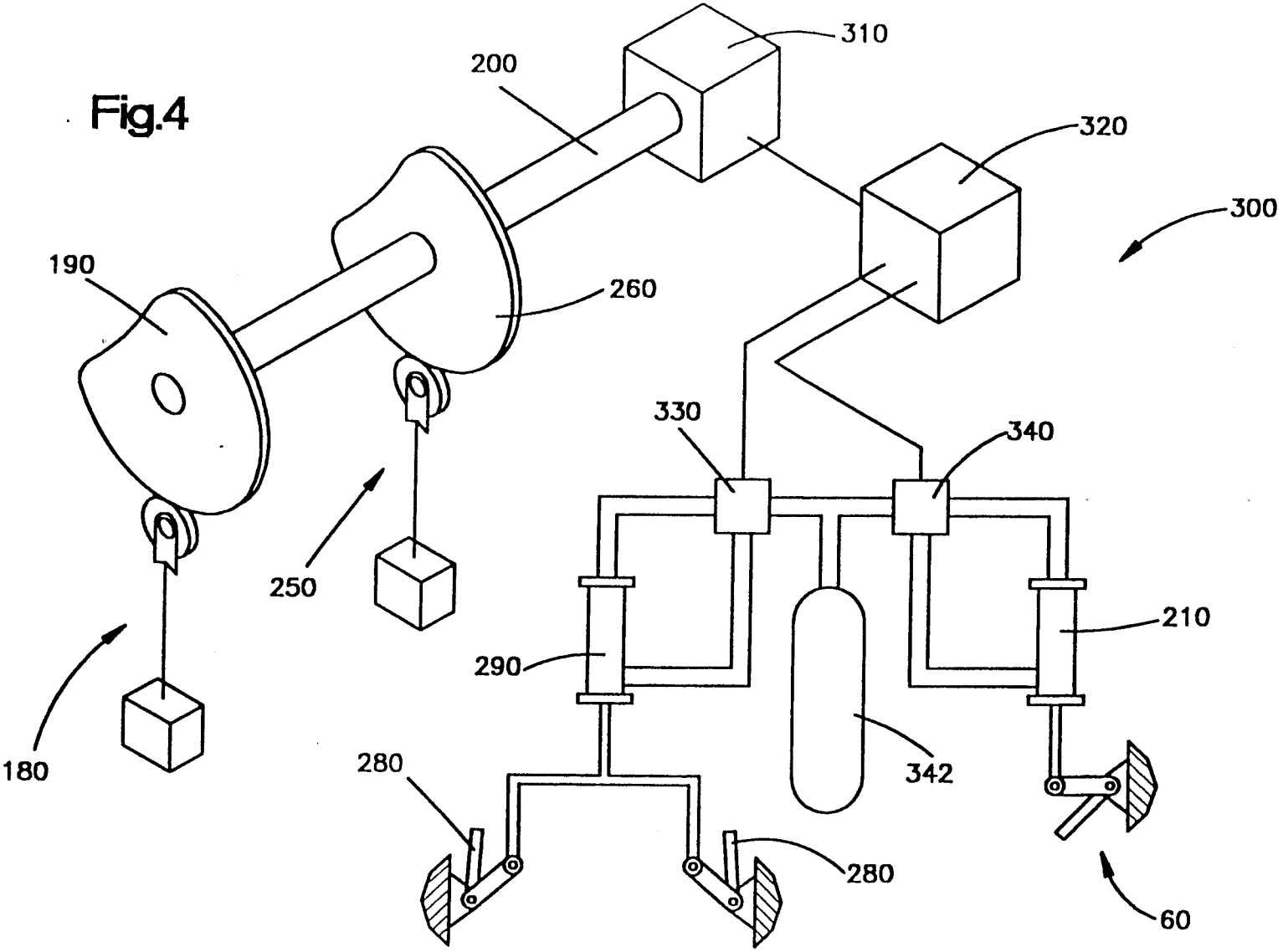
FIG. 4 is a schematic view of the timing apparatus of the labeling apparatus.

The advancing conveyor 80 is proximate the presenting station 50 and includes a pusher 140, a barrier arm 150, and a slider arm 160. The pusher 140 engages individual bottles 30 to push them along the slide plate 70 toward the work station 90 and then returns. The movement of the pusher 140 is repeated in continuous cyclic fashion. The barrier arm 150 blocks the downstream bottle on the input conveyor 46 from entering the presenting station 50 until the pusher 140 has fully returned as illustrated in FIG. 3. The slider arm 160 slides on a pair of parallel guide bars 170 for guiding the advancing conveyor's reciprocating motion. A pusher cam follower mechanism 180 is connected to the slider arm 160 for driving the slider arm 160 in a predetermined synchronized motion Preferably, the pusher cam follower mechanism 180 is driven by a pusher cam 190 connected to a main drive shaft 200 as illustrated in FIG. 4.

The entrance gate 60 is located adjacent the pusher 140 to block or unblock the path of the bottles. The entrance gate 60 is preferably opened and closed by the operation of a pneumatic cylinder 210 connected thereto as illustrated in FIG. 4. The entrance gate 60 is timed to open as the pusher 140 begins driving a bottle 30 towards the work station 90. The bottle entrance gate 60 serves to restrain the bottle 30 in the presenting station 50, which is under constant force by the neighboring upstream bottle on the input conveyor 40. The bottle 30 at the presenting station 50 tends to be jostled in the downstream direction by incoming bottles on the input conveyor 40 if not restrained by the entrance gate 60.

Figure 5:
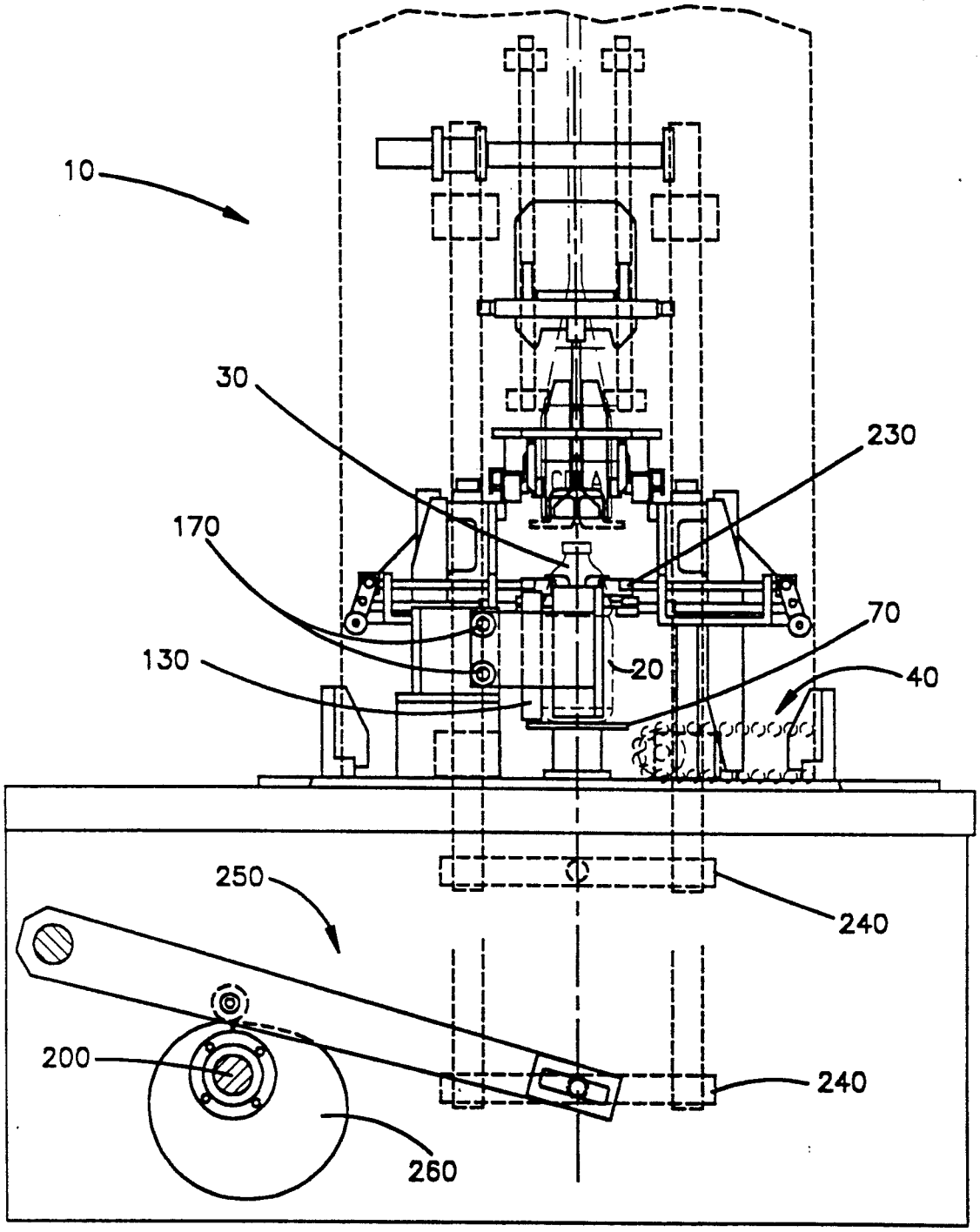
FIG. 5 is a front elevational view of the labeling apparatus with portions cut away.

Downstream of the presenting station 50 is the work station 90. The work station 90 comprises a labeling tool 220 for continuously and cyclically applying sleeve labels 20 to individual bottles 30. The labeling tool 220 is essentially the same as that disclosed in U.S. Pat. No. 4,944,825 which has been incorporated by reference. Further details of the labeling tool are disclosed in U.S. Pat. Nos. 4,620,888, 4,412,876, 4,565,592, and 4,412,876, all of which are hereby incorporated by reference. An opposed pair of label appliers 230 reciprocate in a vertical plane on a carriage 240 (FIG. 5). During a portion of their cycle, the label appliers 230 are clear of the bottle 30 in the work station 90 so the bottle may move into or out of the work station 90 without interference. The label appliers 230 are synchronized to move in a predetermined relationship to the pusher 140, the entrance gate 60, and the exit gate 100. Preferably, the label appliers 230 are driven by a labeling cam follower mechanism 250 which is in turn driven by a labeling cam 260 connected to the main drive shaft 200 as illustrated in FIGS. 4 and 5.

The work station 90 includes a vacuum stabilizer. Vacuum ports 270 are formed in the slider plate 160 such that the bottom of each bottle 30 being labeled substantially covers the ports 270. Vacuum is communicated with the ports 270 to hold the bottles 30 in position. This feature prevents bottles 30 from rocking or sliding even if fluid within the bottles is splashing around thus preventing misregistration.

Downstream from the work station 90 is the exit conveyor 110 for carrying labeled bottles away. The exit conveyor 110 is preferably a continuously running flat belt conveyor. Located above an upstream portion of the exit conveyor is the exit gate 100. The exit gate 100 comprises two movable arms 280 which are operable to block or unblock the bottle path. The exit gate 100 is preferably operated by a pneumatic cylinder 290 as illustrated in FIG. 4. The exit gate 100 is synchronized to operate in predetermined relation to the position of the pusher 140, the label appliers 230, and the entrance gate 60. The exit gate 100 is operated to halt a labeled bottle leaving the work station 90 so that the halted, labeled bottle serves as a registration stop for the next bottle to be labeled A bottle just labeled is driven out of the work station 90 by an incoming bottle pushed by the advancing conveyor 80. The exit gate 100 is located at a predetermined distance downstream from the work station 90 for a given bottle size so that the next bottle to be labeled will be properly located when it abuts the halted bottle Once the upstream bottle has been registered with respect to the work station 90, the halted bottle is released The halted bottle rests on the moving exit conveyor 110 and is prevented from moving only by the exit gate 100. Thus, once the exit gate 100 is opened, the halted bottle immediately moves downstream.

A timing apparatus 300 is provided for synchronizing the above described events. As illustrated in FIG. 4, the main drive shaft 200 drives the pusher and labeling cams 190, 260. The pusher cam 190 is connected to the pusher cam follower mechanism 180 for operating the advancing conveyor 80. Reciprocating motion from the pusher cam follower mechanism 180 is transferred to the slider arm 160 in a manner well understood by those with ordinary mechanical skill. The labeling cam 260 is connected to the labeling cam follower mechanism 250 for driving the label appliers 230 cyclically up and down.

The timing apparatus 300 further includes an encoder device 310 for producing digital signals corresponding to discrete rotational positions of the main drive shaft 200. For example, an encoder sold under the name BEI model H25D-CCW-8CG-7406-EM20-S may be used. The signals from the encoder device 310 are sent to a microprocessor 320 which is programmed to send operating signals to entrance-gate and exit-gate valves 340, 330 which control the operation of the entrance and exit gate pneumatic cylinders 210,290, respectively. The valves 340 and 330 are operable to connect or disconnect opposite ends of the pneumatic cylinders 210,290 with a pressurized air supply 342. Thus, at the appropriate times in the labeling cycle, as determined by the rotational position of the main drive shaft 200, the entrance and exit gates 60, 100 are either opened or closed with air pressure.

Figure 6:
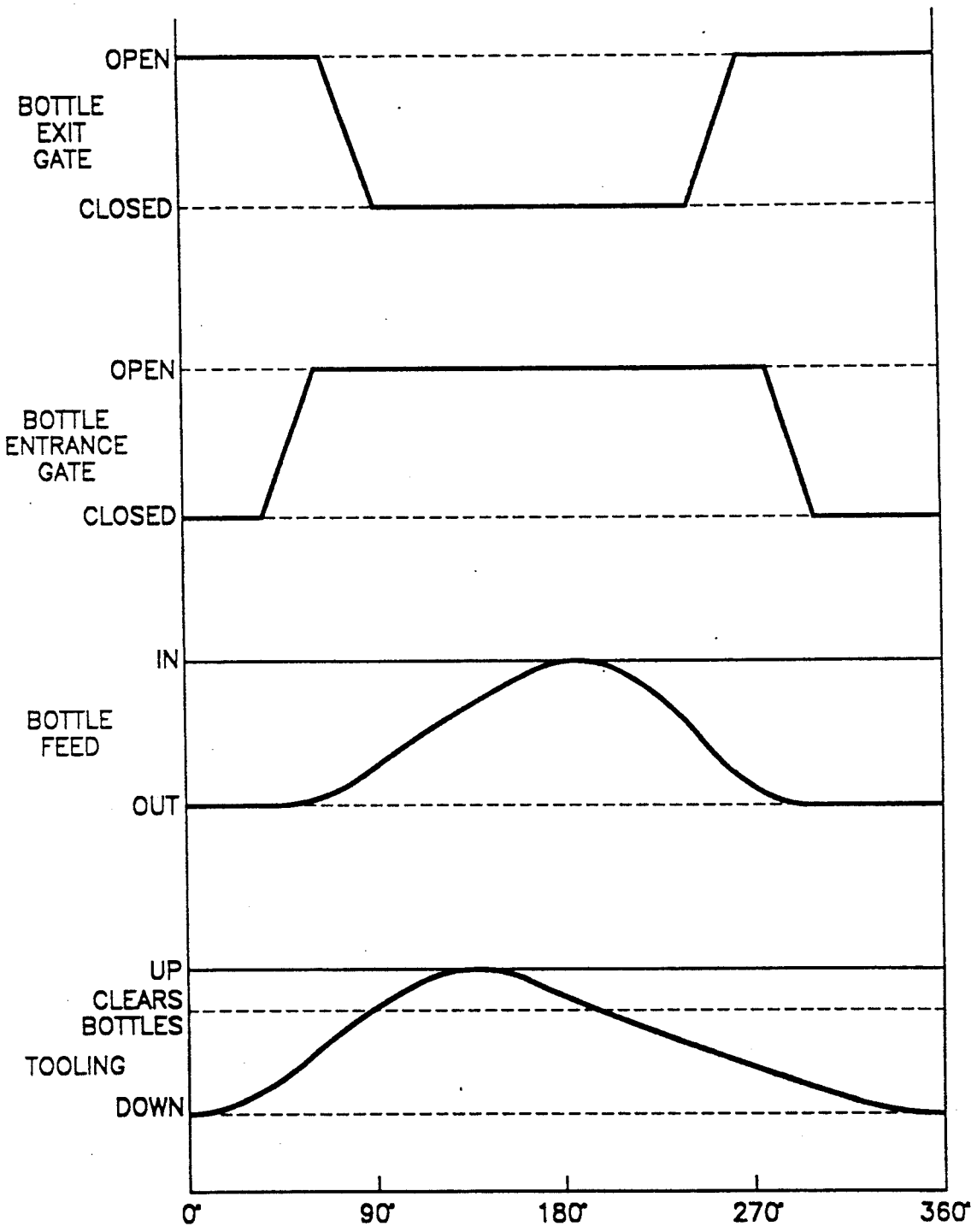
FIG. 6 is a timing diagram showing the positions of the various parts of the labeling apparatus as a function of the rotational position of the main shaft of the labeling apparatus.

FIG. 6 illustrates a timing diagram showing the rotational position of the main drive shaft 200 on the horizontal axis. The various positions of the exit gate 100, entrance gate 60, pusher 140, and label appliers (tooling) 230 are designated on the vertical axis. The bottle exit and entrance gate positions are designated as open or closed on the vertical axis of FIG. 6. The "closed" position is the position where the path of the bottles is blocked. The position of the pusher 140 is designated as "bottle feed." The position labeled "in" is the pusher position away from the presenting station and toward the work station 90. The position of the label appliers 230 is labeled as "tooling." A horizontal broken line labeled "clears bottle" indicates the point in the cycle at which the label appliers 230 are clear of the bottle 30. During the portion of the tooling cycle which is above the broken line, the bottle 30 may move in or out of the work station 90 without interference.

As shown in FIG. 6, the pusher 140 pushes a bottle toward the work station 90 only when the exit gate 100 is closed or closing and while the entrance gate 60 is open. The predecessor bottle is driven out of the work station 90 and into the exit gate 100 The exit gate 100 is opened during the downward stroke of the label appliers 230 (tooling) to release the bottle blocked by the exit gate 100 thus isolating the bottle being labeled. Since the bottle being labeled is isolated from the stream, there is ample clearance around it for operation of the label appliers 230.

Thus, a method has been described for labeling bottles 30 as follows: Bottles 30 are advanced to be labeled to the presenting station 50 using the input conveyor 40. Bottles 30 are then engaged by the pusher 140 and driven toward the work station 90. A downstream bottle 30, having been labeled, is pushed out of the work station 90 with the bottle to be labeled being driven with the pusher 140. The labeled bottle is then halted by the exit gate 100 to serve as a registration stop for the bottle to be labeled. Once the bottle to be labeled is registered with respect to the work station 90, the downstream labeled bottle is conveyed further downstream to isolate the bottle in the work station 90. Thereafter, a label 20 is applied to the registered bottle. The process is then repeated Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A method for labeling tubular product containers with tubular sleeves, comprising the steps of:

(a) advancing a container to be labeled to a product presenting position;

(b) engaging said container at the presenting position with an advancing conveyor and driving said engaged container toward a labeling station;

(c) pushing a predecessor container out of said labeling station with said driven container;

(d) halting said predecessor container with a downstream gate;

(e) registering said driven container at said labeling station by stopping it with said predecessor container;

(f) conveying said predecessor container further downstream; and (g) applying one of said tubular sleeves to said registered container.

2. The method of claim 1 further including the step of blocking a path between said presenting position and said labeling station until such time as said engaged container is driven.

3. A process for registering individual objects in a stream of objects being conveyed by a conveyor system, said process comprising the steps of:

conveying an object along a flow path toward a work station on said path;

closing an exit gate across said path to block said flow path downstream of said work station;

registering said conveyed object against a stationary downstream object held stationary by said exit gate; and thereafter, opening said exit gate to release said downstream object while holding said conveyed object stationary.

4. A process according to claim 3 further comprising the steps of closing an entrance gate across the path upstream of said work station to selectively block said flow path, and opening said entrance gate to unblock said flow path before conveying an object toward said work station.

5. A process for registering objects according to claim 4, and further including the step of closing said entry gate after said exit gate is opened to prevent upstream bottles from approaching said work station for a predetermined period of time.

6. The process of claim 3 further including the step of labeling the conveyed object after it has been registered and substantially concurrently with the step conveying the downstream object further downstream.

7. a method of applying sleeve labels to bottles comprising:

a) applying a label to a first bottle positioned at a labelling station;

b) transporting the first bottle from the labeling station while concurrently transporting a second bottle toward the station;

c) arresting the motion of the first bottle at a bottle locating position;

d) locating the second bottle at the labeling station by causing it to engage the first bottle while its motion is arrested at the locating position; and, e) applying a label to the second bottle as the first bottle is transported from the locating position.

8. The process of claim 7 further including repeating steps (b) through (e) inclusive with further bottles.

9. The process of claim 7 wherein the arresting step is accomplished with a gate.

10. The process of claim 7 further including the step of filling each bottle prior to labeling.

* * * * *